US005801731A

United States Patent [19]

Takahashi

[11] Patent Number: 5,801,731

[45] Date of Patent: Sep. 1, 1998

[54] INK DROPLET EJECTING DEVICE WITH A CONTINUOUS ELECTRODE

[75] Inventor: Yoshikazu Takahashi, Kasugai, Japan

[73] Assignee: Brother Kogyo Kabushiki Kaisha, Nagoya, Japan

[21] Appl. No.: 344,672

[22] Filed: Nov. 21, 1994

[30] Foreign Application Priority Data

Dec. 24, 1993 [JP] Japan ..... 5-326997

[51] Int. Cl.[6] ..... B41J 2/045

[52] U.S. Cl. ..... 347/69; 347/71

[58] Field of Search ..... 347/68, 69, 71, 347/94; 346/140.1, 140

[56] References Cited

U.S. PATENT DOCUMENTS

| | | | |
|---|---|---|---|
| 3,946,398 | 3/1976 | Kyser et al. | 347/68 |
| 4,723,129 | 2/1988 | Endo et al. | 347/56 |
| 4,879,568 | 11/1989 | Bartky et al. | 347/69 |
| 5,252,994 | 10/1993 | Narita et al. | 347/71 |
| 5,363,133 | 11/1994 | Sugahara et al. | 347/69 |
| 5,518,952 | 5/1996 | Vonasek et al. | 437/82 |

FOREIGN PATENT DOCUMENTS 2264086 8/1993 European Pat. Off. .

*Primary Examiner*—Benjamin R. Puller
*Assistant Examiner*—Charlene Dickens
*Attorney, Agent, or Firm*—Oliff & Berridge, PLC

[57] ABSTRACT

An ink droplet ejecting device includes first and second grooves formed on a piezoelectric ceramic plate. The positions of the first and second grooves are offset by a half pitch and are formed by cutting. A cover plate closes openings of the grooves at one side of the piezoelectric ceramic plate. The first grooves become gradually shallower toward one end surface of the piezoelectric ceramic plate to form flat surface portions so that the second grooves do not intercommunicate with a manifold of the cover plate. Further, first metal electrodes are formed on inner surfaces of the first grooves, and second and third metal electrodes are simultaneously formed on inner surfaces of the second grooves on the whole surface of the piezoelectric ceramic plate where the second grooves are formed. The second metal electrodes on the inner surfaces of all the second grooves are electrically connected to one another by the third metal electrodes, and the metal electrodes are connected to an LSI chip through a flexible circuit pattern. A method of manufacturing an ink droplet ejecting device also is described.

11 Claims, 7 Drawing Sheets

INK DROPLET EJECTING DEVICE WITH A CONTINUOUS ELECTRODE

CROSS-REFERENCE TO RELATED APPLICATION

The subject matter of this application is related to the subject matter of commonly assigned application Ser. No. 08/348,123, filed Nov. 28, 1994.

BACKGROUND OF THE INVENTION

1. Field of the Invention

The present invention relates to an ink-ejecting device and method of manufacture.

2. Description of Related Art

Non-impact-type printing devices have recently replaced conventional impact-type printing devices and have greatly propagated in the market. Ink-ejecting-type printing devices are known for simple operation and effective use in multi-gradation and coloration printing. Of these devices, drop-on-demand-type devices, which eject only ink droplets for printing, have propagated rapidly because of their excellent ejection efficiency and low operation cost.

A drop-on-demand device is disclosed in U.S. Pat. No. 3,946,398 to Kyser. A thermal-ejecting-type drop-on-demand device is disclosed in U.S. Pat. No. 4,723,129 to Endo. The former type is difficult to design in a compact size. The latter type requires ink having heat-resistance, because the ink is heated at high temperature. Accordingly, these devices are cumbersome to use and have many problems.

A shear-mode-type device, disclosed in U.S. Pat. No. 4,879,568 to Bartky et al., has been proposed to simultaneously solve the above problems.

As shown in FIGS. 9A and 9B, a shear-mode-type ink-ejecting device 600 as described above comprises a bottom wall 601, a ceiling wall 602 and a shear mode actuator wall 603 therebetween. The actuator wall 603 comprises a lower wall 607 that is adhesively attached to the bottom wall 601 and polarized in a direction as indicated by an arrow 611, and an upper wall 605 that is adhesively attached to the ceiling wall 602 and polarized in a direction as indicated by an arrow 609. A pair of actuator walls 603 thus formed forms an ink channel 613 therebetween, and a space 615 that is narrower than the ink channel 613 is formed between neighboring pairs of actuator walls 603.

A nozzle plate 617 having nozzles 618 formed therein is fixedly secured to one end of each ink channel 613, and electrodes 619 and 621 are provided as metallized layers on both side surfaces of each actuator wall 603. Each of the electrodes 619 and 621 is covered by an insulating layer (not shown) to insulate it from the ink. The electrodes 619, 621 that face the space 615 are connected to the ground 623, and the electrodes that are provided in the ink channel 613 are connected to a silicon chip 625, which forms an actuator driving circuit.

Next, a manufacturing method for the ink-ejecting device 600 as described above will be described. First, a piezoelectric ceramic layer that is polarized in a direction as indicated by an arrow 611 is adhesively attached to the bottom wall 601, and a piezoelectric ceramic layer that is polarized in a direction as indicated by an arrow 609 is adhesively attached to the ceiling wall 602. The thickness of each piezoelectric ceramic layer is equal to the height of each of the lower wall 607 and the upper wall 605. Subsequently, parallel grooves are formed on the piezoelectric ceramic layers by rotating a diamond cutting disc or the like to form the lower wall 607 and the upper wall 605. Further, the electrode 619 is formed on the side surface of the lower wall 607 by a vacuum-deposition method, and the insulating layer as described above is provided onto the electrode 619. Likewise, the electrode 621 is provided on the side surface of the upper wall 605, and the insulating layer is further provided on the electrode 621.

The vertex portions of the upper wall 605 and the lower wall 607 are adhesively attached to one another to form the ink channels 613 and the spaces 615. Subsequently, the nozzle plate 617 having the nozzles 618 formed therein is adhesively attached to one end of the ink channels 613 and the spaces 615 so that the nozzles 618 face the ink channels 613. The other end of the ink channels 613 and the spaces 615 are connected to the silicon chip 625 and the ground 623.

A voltage is applied to the electrodes 619 and 621 of each ink channel 613 from the silicon chip 625, whereby each actuator wall 603 suffers a piezoelectric shear mode deflection in such a direction that the volume of each ink channel 613 increases. The voltage application is stopped after a predetermined time elapses, and the volume of each ink channel 613 is restored from a volume-increased state to a natural state, so that the ink in the ink channels 613 is pressurized and ink droplets are ejected from the nozzles 618.

In the ink-ejecting device 600 as described above, the electrodes 619 and 621 that face the spaces (air channels) 615 are connected to the ground 623, and the electrodes 619 and 621 that are provided in the ink channels 613 are connected to silicon chip 625, which serves as an actuator driving circuit.

U.S. Pat. No. 4,879,568 fails to disclose a scheme or method for the above-described electrical connection. Therefore, for example, assuming the number of ink channels 613 to be fifty, fifty-one air channels 615 are required, and the electrical connection of the electrodes 619 and 621 must be performed at 101 connection positions. The connection positions are disposed at a narrow pitch, and thus it is difficult to form the connections and a long time is required to form the connections so that mass production is low.

SUMMARY OF THE INVENTION

An object of this invention is to provide an ink-ejecting device affording excellent mass production and allowing electrical connections to be formed easily.

To attain the above and other objects, an ink-ejecting device according to an embodiment of the invention includes plural ink-ejecting channels for ejecting ink, plural non-ink-ejecting areas formed at both sides of the ink-ejecting channels in a groove-like shape having an opening and in which no ink is ejected, partition walls that serve to separate the ink-ejecting channels and the non-ink-ejecting areas from one another, at least a part of each partition wall preferably being formed of polarized piezoelectric ceramic material, first electrodes that are provided at the ink-ejecting channel sides of the partition walls, second electrodes that are provided at the non-ink-ejecting area sides of the partition walls, and third electrodes for electrically connecting the second electrodes to one another through the bottom surfaces and opening portions of the grooves of the non-ink-ejecting areas.

The ink-ejecting channels are constructed by an actuator plate having the plural grooves, which are separated from one another by the partition walls, and a cover member for closing the opening portions of the grooves of the actuator plate. The non-ink-ejecting areas are opened at the opposite sides to the opening portion sides of the grooves of the actuator plate, and the second and third electrodes are simultaneously formed at the side opposite to the opening portion sides of the grooves of the actuator plate.

Further, the ink-ejecting channels are constructed by the actuator plate having the plural grooves, which are separated from one another by the partition walls, and a cover member for closing the opening portions of the grooves of the actuator plate. The non-ink-ejecting areas are opened at the side opposite to the cover member to the actuator plate side, and the second and third electrodes are simultaneously formed at the side of the cover member opposite to the actuator plate side.

In an ink-ejecting device according to an embodiment of the present invention thus constructed, the partition walls separate the ink-ejecting channels and the non-ink-ejecting areas from one another, the first electrodes are formed at the ink-ejecting channel sides of the partition walls, and the second electrodes are formed at the non-ink-ejecting area sides of the partition walls. Further, the second electrodes are electrically connected to one another by the third electrodes, which are formed through the bottom surfaces of the grooves of the non-ink-ejecting areas and the opening portions of the grooves. Each of the first electrodes is individually supplied with a voltage, and all the second electrodes are grounded through the third electrodes, whereby the partition walls are deflected and the ink is ejected from the ink-ejecting channels. As is apparent from the foregoing, according to this ink-ejecting device, the partition walls insulate the ink-ejecting channels and the non-ink-ejecting areas from one another, the first electrodes are formed at the ink-ejecting channel sides of the partition walls, and the second electrodes are formed at the non-ink-ejecting area sides of the partition walls. The second electrodes are connected to the controller in a state where the second electrodes are connected to one another by the third electrodes, which are formed through the bottom surfaces of the grooves of the non-ink-ejecting areas and the opening portions of the grooves. Therefore, the first electrodes are individually connected to the controller while being electrically independent of one another, and the electrical connection of the second electrodes to the controller can be performed at at least one position. Accordingly, the number of electrical connections is reduced, and electrical connection to the controller can be facilitated. Further, the pitch of the first electrodes is wider than in the prior art, so that the electrical connection of the first electrodes to the controller can be easily performed. Still further, with the non-ink-ejecting areas, each of which is formed in a groove-shape having an opening, ink droplets can be ejected from a desired ink-ejecting channel by piezoelectric thickness shear mode deflection of the partition walls without affecting the other ink-ejecting channels, so that high print quality can be obtained.

BRIEF DESCRIPTION OF THE DRAWINGS

Preferred embodiments according to the present invention will be described in detail with reference to the following figures wherein.

DETAILED DESCRIPTION OF PREFERRED EMBODIMENTS

Figure 1:
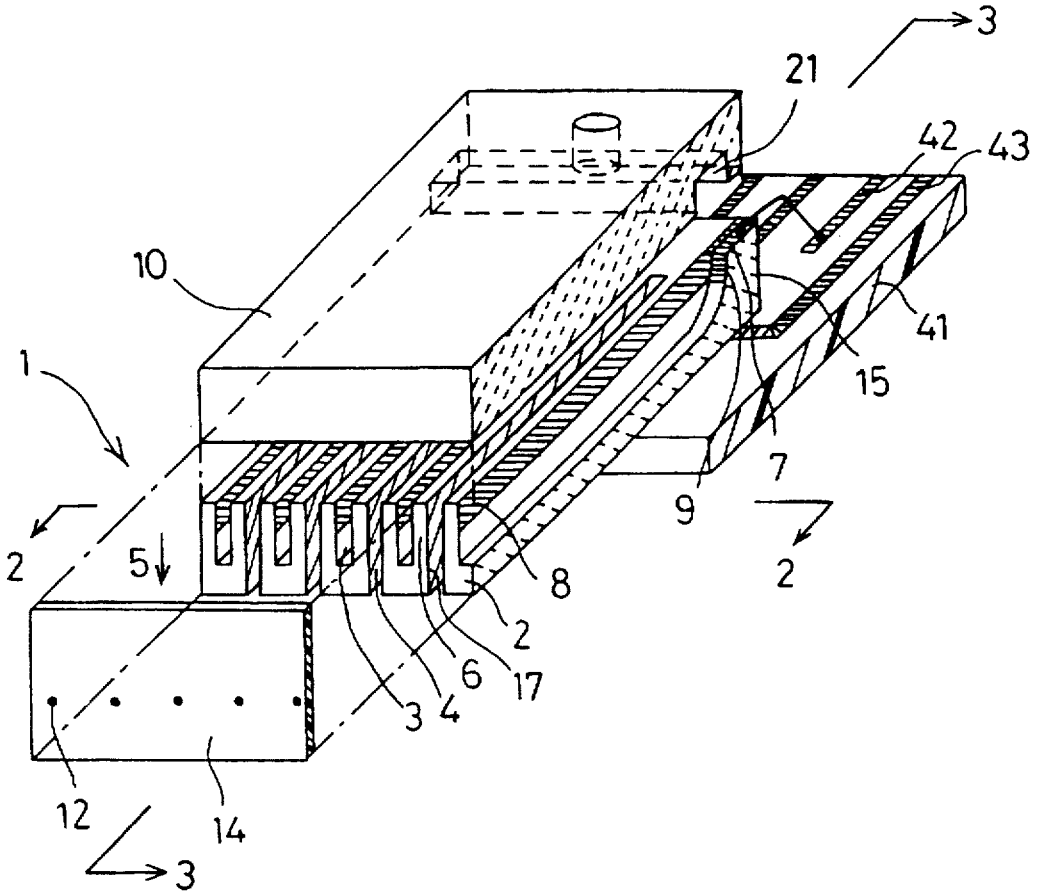
FIG. 1 is a perspective view showing an ink-ejecting device according to a first embodiment of the invention.

Preferred embodiments according to the present invention will be described with reference to the accompanying drawings. A first embodiment will be described with reference to FIGS. 1 to 5. First, an ink-ejecting device 1 and a method of manufacturing the ink-ejecting device will be described with reference to FIGS. 1, 2 and 3.

The ink-ejecting device 1 comprises a piezoelectric ceramic plate 2, a cover plate 10 and a nozzle plate 14. The piezoelectric ceramic plate 2 is formed of ceramic material, preferably of lead zirconate titanate. The piezoelectric ceramic plate 2 is formed with plural grooves 19 by cutting, using a diamond blade or the like. Partition walls serving as the side surfaces of the grooves 19 are polarized in a direction as indicated by an arrow 5. These grooves 19 are of the same depth and are parallel to one another. The depth of each groove 19 becomes gradually shallower toward one end surface 15 of the piezoelectric ceramic plate 2, thereby forming shallow grooves 7. Thereafter, a metal electrode 8 serving as a first electrode is formed on the inner surface of each groove 19, more particularly, on an upper half portion of both side surfaces of each groove 19, by a sputtering process or the like. Further, a metal electrode 9 is formed on the side surfaces and the bottom surface of the inner surface of each shallow groove 7. By this process, the metal electrodes 8 formed at both side surfaces of the grooves 19 are electrically connected to each other by the metal electrodes 9 formed in the shallow grooves 7. Subsequently, an insulation layer (not shown) for insulating the ink from the metal electrodes 8 is formed on the metal electrodes 8.

Next, the cover plate 10, which is formed of ceramic material and provided with a manifold 21, is adhesively attached through an epoxy adhesive agent 20 to the surface of the piezoelectric ceramic plate 2, on which the grooves 19 are formed. With this process, the grooves 19 are closed to thereby form the ink channels 3.

At the side surface opposite to the surface of the piezoelectric ceramic plate on which the grooves 19 are formed, grooves 4 serving as non-ink-ejecting areas are formed by cutting, using a diamond blade or the like, positionally deviated from the grooves 19 at a half pitch. The depth of the grooves 4 because gradually shallower toward one end surface 15 of the piezoelectric ceramic plate 2, as shown by the curved dashed line in FIG. 3, for example, and finally the grooves 4 become flat surface portions 16 of the plate 2. The grooves 4 are designed so as to be shallow just before the manifold 21, so that they are prevented from intercommunicating with the manifold 21, as described later. The grooves 19, the partition walls 6 and the grooves 4 are of the same width.

Metal electrodes 17 serve as second electrodes 32 and third electrodes 33, and are simultaneously formed. The second electrodes 32 are formed on the inner surfaces of the grooves 4. The third electrodes 33 are formed on the bottom surface of the plate 2, in which the grooves 4 are formed, including on the flat surface portions 16. Accordingly, the metal electrodes 17 in all the grooves 4 are electrically connected to one another. The second electrode 32 is the electrode formed on the inner side surface of the groove 4 and the third electrode 33 is the electrode that connects the second electrodes 32.

Accordingly, the ink-ejecting device 1 is provided with the ink channels 3 serving as the ink-ejecting channels, which intercommunicate with the manifold 21, and the grooves 4 serving as the non-ink-ejecting areas, which do not intercommunicate with the manifold 21. The ink channels 3 are designed in a slender form having a rectangular section, and all the ink channels 3 are filled with ink. To prevent leakage of the ink from the shallow grooves 7, an epoxy adhesive agent (not shown) is provided in the neighborhood of the joint portion of the shallow grooves 7 and the cover plate 10.

Thereafter, the nozzle plate 14, which is provided with the nozzles 12 at the positions corresponding to the ink channels 3, is adhesively attached to the end surfaces of the piezoelectric ceramic plate 2 and the cover plate 10. The nozzle plate 14 preferably is formed of plastic material such as polyalkylene (for example, ethylene) terephthalate, polyimide, polyether imide, polyether ketone, polyether sulfone, polycarbonate, cellulose acetate or the like.

Next, the construction of a controller will be described with reference to FIG. 5, which is a block diagram of a preferred controller.

A conductive-layer pattern 24 on a flexible circuit 23 is connected to the metal electrodes 9 of the shallow grooves 7 through a conductive pattern 42 formed on a substrate 41 (FIG. 1), and a pattern 25 is connected to the metal electrodes 17 of the flat surface portion 16 through a conductive pattern 43 formed on the substrate 41 (FIG. 1). Each of the patterns 24 and 25 is individually connected to an LSI chip 51, and a clock line 52, a data line 53, a voltage line 54 and a ground line 55 also are connected to the LSI chip 51. On the basis of a sequence of clock pulses supplied from the clock line 52, the LSI chip 51 identifies, from data appearing on the data line 53, a nozzle 12 through which an ink droplet should be ejected, and applies a voltage V of the voltage line 54 to the pattern 24 of the conductive layer. The voltage is conducted to the metal electrodes 8 in an ink channel 3 to be driven. Further, the LSI chip 51 connects the ground line 55 to the pattern 25, which is connected to the metal electrodes 17 of the grooves 4, and to the pattern 24 connected to the metal electrodes 8 other than the metal electrodes in the ink channel 3 to be driven.

Next, the operation of the ink-ejecting device according to the first embodiment will be described.

Figure 4:
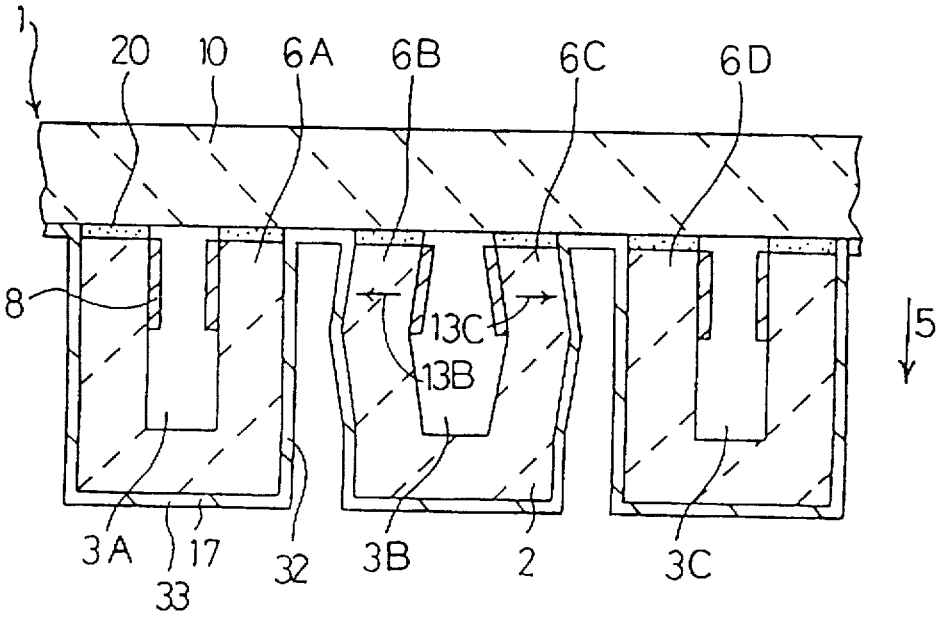
FIG. 4 is a diagram showing operation of the FIG. 1 ink-ejecting device.

When an ink droplet is ejected from an ink channel 3B, shown in FIG. 4, a voltage pulse is applied to the ink channel 3B (here, the application of the voltage to the ink channel 3 means that the voltage is applied to the metal electrodes facing the ink channel 3, and the metal electrodes 8 facing the ink channels that are not specified and the metal electrodes 17 of the grooves 4 are grounded). Through this voltage application, an electric field acting in a direction as indicated by an arrow 13B occurs on a partition wall 6B, and an electric field acting in a direction as indicated by an arrow 13C occurs on a partition wall 6C. At this time, the polarization direction 5 and the direction of the electric field 13 are perpendicular to each other, so that the partition walls 6B and 6C are deflected in a piezoelectric thickness shear mode and moved so as to be away from each other. In this case, the volume of the ink channel 3B is increased, and the pressure in the ink channel 3B (containing a peripheral portion of the nozzle 12) is reduced (negative pressure occurs). This state is maintained for a time represented by L/a. During this time, ink is supplied from an ink supply source (not shown) through the manifold 21 into the ink channel. The time L/a is the time required for one-way propagation of pressure wave in a longitudinal direction of the ink channel 3 (from the manifold 21 toward the nozzle plate 14, or from the nozzle plate 14 toward the manifold 21), and it is determined by the length of the ink channel 3 and the sound velocity a in the ink.

According to pressure wave propagation theory, the pressure in the ink channel 3B is inverted when a time of L/a elapses from the voltage application as described above, so that pressure varies its polarity to a positive pressure. In synchronism with this timing, the voltage applied to the ink channel 3B is returned to OV. At this time, the partition walls 6B and 6C return to their initial states before deflection (FIG. 2), and the ink is pressurized. At this time, the positively varied pressure as described above is summed with a pressure that is induced by the return of the partition walls 6B and 6C to their initial states before deflection, so that a relatively high pressure is applied to the ink in the ink channel 3B and an ink droplet is ejected from the nozzle 12.

According to the first embodiment, the driving voltage is applied to increase the volume of the ink channel 3B, and then the application of the driving voltage is stopped to reduce the volume of the ink channel 3B to its natural (initial) state, thereby ejecting an ink droplet from the ink channel 3B. However, the driving voltage also can be applied first to reduce the volume of the ink channel 3B, thereby ejecting an ink droplet from the ink channel 3B, and then the application of the driving voltage is stopped to increase the volume of the ink channel 3B from the reduced state to the natural (initial) state, thereby supplying the ink into the ink channel 3B.

Further, according to the first embodiment, the metal electrodes 9 and 17 are connected to the conductive patterns 24 and 25 of the flexible circuit through the conductive patterns 42 and 43 that are formed on the substrate 41. However, the metal electrodes also may be connected directly to the flexible circuit, with no substrate 41.

Figure 2:
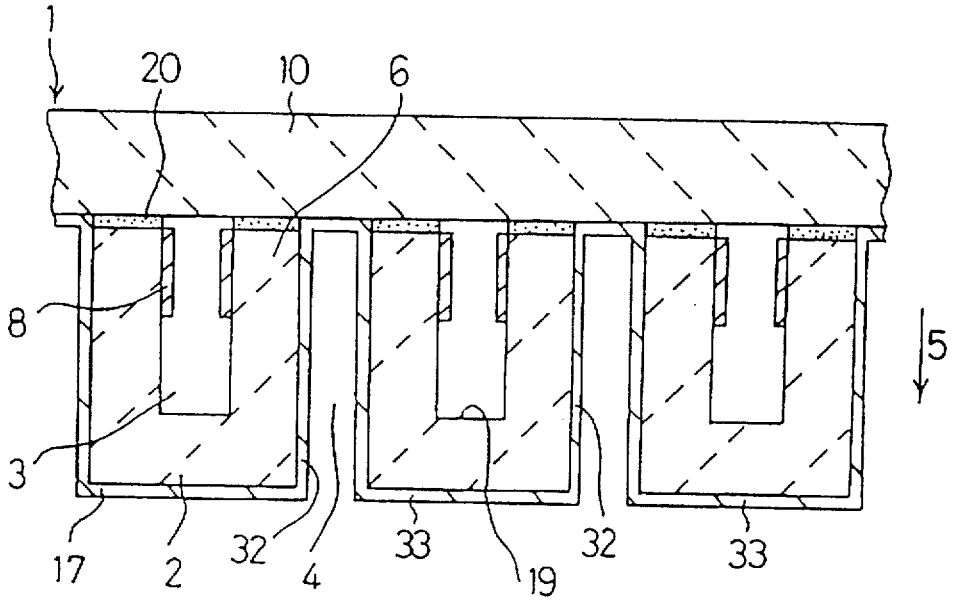
FIG. 2 is a cross-sectional view of the FIG. 1 ink-ejecting device, taken along line 2—2 of FIG. 1.
Figure 3:
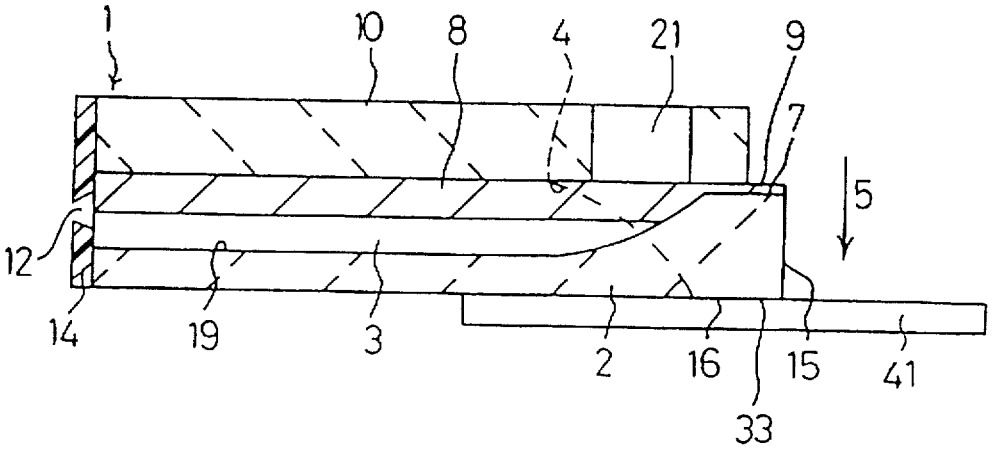
FIG. 3 is a cross-sectional view of the FIG. 1 ink-ejecting device, taken along line 3—3 of FIG. 1.

As described above, in the ink-ejecting device 1 according to the first embodiment, the metal electrodes 17 can be formed simultaneously and easily on the inner surfaces of the grooves 4 and on the whole surface (containing the flat surface portion 16) of the piezoelectric ceramic plate 2 on which the grooves 4 are formed, because the grooves 4 are opened (FIG. 2). Further, the metal electrodes 9 of the shallow grooves 7 of the ink channels 3 are individually and electrically independent of one another, and all the metal electrodes 17 on the inner surfaces of the grooves 4 are electrically connected to one another. Therefore, the electrical connection of the metal electrodes 17 on the inner surfaces of all the grooves 4 to the ground can be performed at at least one position. Accordingly, the connection to the patterns 24 and 25 of the flexible circuit 23, to connect the metal electrodes 17 to the LSI chip 51, can be facilitated.

According to the first embodiment, the grooves 4 are opened to the surface of the piezoelectric ceramic plate 2, which is at a side opposite to the cover plate 10. The grooves do not intercommunicate with the manifold 21. Therefore, the grooves 4 are filled with air, and thus the deflection of the partition walls 6B and 6C to eject an ink droplet from the ink channel 3B has no effect on the other ink channels 3A, 3C, etc. Accordingly, the ink droplet is precisely ejected from each ink channel 3, and excellent print quality can be obtained. Further, since the grooves 4 are filled with air, the partition walls 6 are easily deflected, and a low driving voltage may be used.

Further, by making the width of the grooves 4 to be smaller than the ink channels 3, the whole width of the piezoelectric ceramic plate 2 can be made smaller, and thus the device itself can be miniaturized.

According to the manufacturing method of this embodiment, the cover plate 10 is adhesively joined to the piezoelectric ceramic plate 2, and then cutting of the grooves 4 occurs. Therefore, better stability for cutting is provided and thus the cutting is performed more easily.

Next, a second embodiment according to the invention will be described. The same elements as the first embodiment are represented by the same reference numerals, and the detailed description thereof is omitted.

Figure 6:
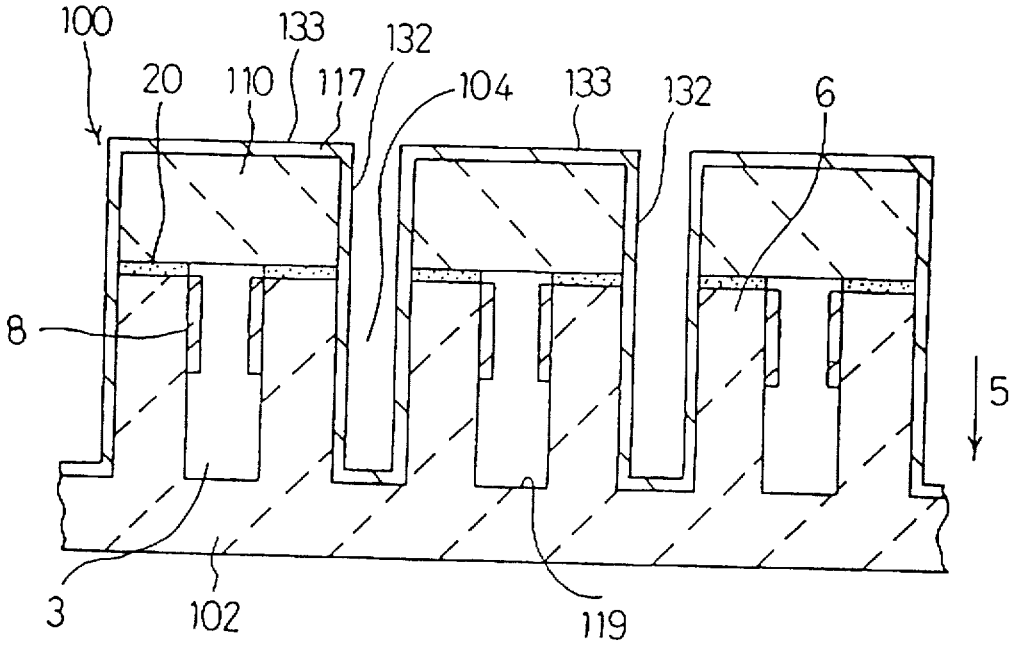
FIG. 6 is a cross-sectional view in a lateral direction of an ink-ejecting device according to a second embodiment.
Figure 7:
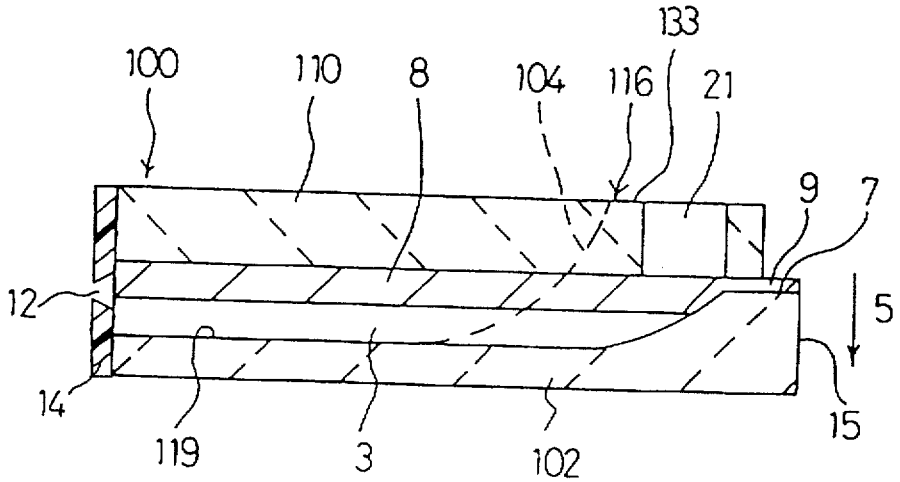
FIG. 7 is a cross-sectional view in a longitudinal direction of the FIG. 6 ink-ejecting device.

First, an ink-ejecting device 100 and a manufacturing method therefor will be described with reference to FIGS. 6 and 7.

The ink-ejecting device 100 comprises a piezoelectric ceramic plate 102, a cover plate 110 and a nozzle plate 14. The piezoelectric ceramic plate 102 is formed of ceramic material, preferably of lead zirconate titanate (PZT). Plural grooves 119 are formed in the piezoelectric ceramic plate 102 by cutting, using a diamond blade or the like. Partition walls 6, which serve as the side surfaces of the grooves 119, are polarized in a direction as indicated by an arrow 5. The grooves 119 are of the same depth and are parallel to one another. The depth of each groove 119 becomes gradually shallower toward one end surface 15 of the piezoelectric ceramic plate 102, thereby forming shallow grooves 7. Thereafter, a metal electrode 8 serving as a first electrode is formed on the inner surface of each groove 119, more particularly, on an upper half portion of both side surfaces of each groove 119, by a sputtering process or he like. Further, a metal electrode 9 is formed on the side surfaces and the bottom surface of the inner surface of each shallow groove 7. By this process, the metal electrodes 8 formed at both side surfaces of the grooves 119 are electrically connected to each other by the metal electrodes 9 formed in the shallow grooves 7. Subsequently, an insulation layer (not shown) for insulating ink from the metal electrodes 8 is formed on the metal electrodes 8.

The cover plate 110 is formed of ceramic material and is provided with a manifold 21. The cover plate 110 and the worked surface of the piezoelectric ceramic plate 102 on which the grooves 119 are formed are joined to each other preferably with an epoxy adhesive agent 20, whereby ink channels 3, serving as ink-ejecting channels, are formed.

Subsequently, the piezoelectric ceramic plate 102 is subjected to cutting using a diamond blade or the like, from the side adjacent cover plate 110, to form grooves 104 of the same depth as the grooves 119 and positionally deviated from the grooves 119 by a half pitch of the grooves 119. The depth of the grooves 104 becomes gradually shallower toward the manifold 21 of the cover plate 102, and the grooves 104 become flat surface portions 116 just before the manifold 21. Accordingly, the grooves 104 do not intercommunicate with the manifold 21. Further, metal electrodes 117 serving as second electrodes 132 and third electrodes 133 are formed on the inner surfaces of the grooves 104 and the worked surface of the cover plate 110 on which the grooves 104 are formed. Therefore, the metal electrodes 117 of all the grooves 104 are electrically connected to one another.

By this process, the ink-ejecting device 100 is provided with the ink channels 3, serving as the ink-ejecting channels intercommunicating with the manifold 21, and the grooves 104, serving as the non-ink-ejecting areas, which do not intercommunicate with the manifold 21. Each ink channel 3 is designed in a slender shape having a rectangular section, and all the ink channels 3 are filled with ink.

To prevent leakage of the ink in the ink channels 3 from the shallow grooves 7, preferably an epoxy adhesive agent (not shown) is provided in the neighborhood of the joint portion between the shallow grooves 7 and the cover plate 110.

The nozzle plate 14, which is provided with the nozzles 12 at the positions corresponding to the ink channels 3, is adhesively attached to the end surface of the piezoelectric ceramic plate 102 and the cover plate 110.

Figure 5:
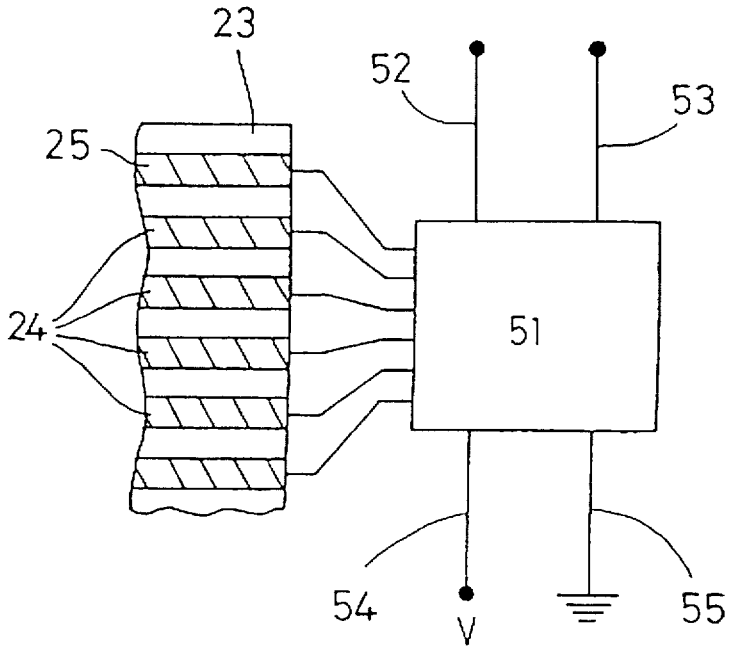
FIG. 5 is a block diagram showing a controller for the FIG. 1 ink-ejecting device.

The conductive-layer pattern 24 that is provided in the flexible circuit 23 shown in FIG. 5 is connected to the metal electrodes 9 of the shallow grooves 7, and the pattern 25 is connected to the metal electrodes 117 of the flat surface portion 116. Both of the patterns 24 and 25 are individually connected to the LSI chip 51.

Next, the operation of the ink-ejecting device 100 according to this embodiment will be described.

Figure 8:
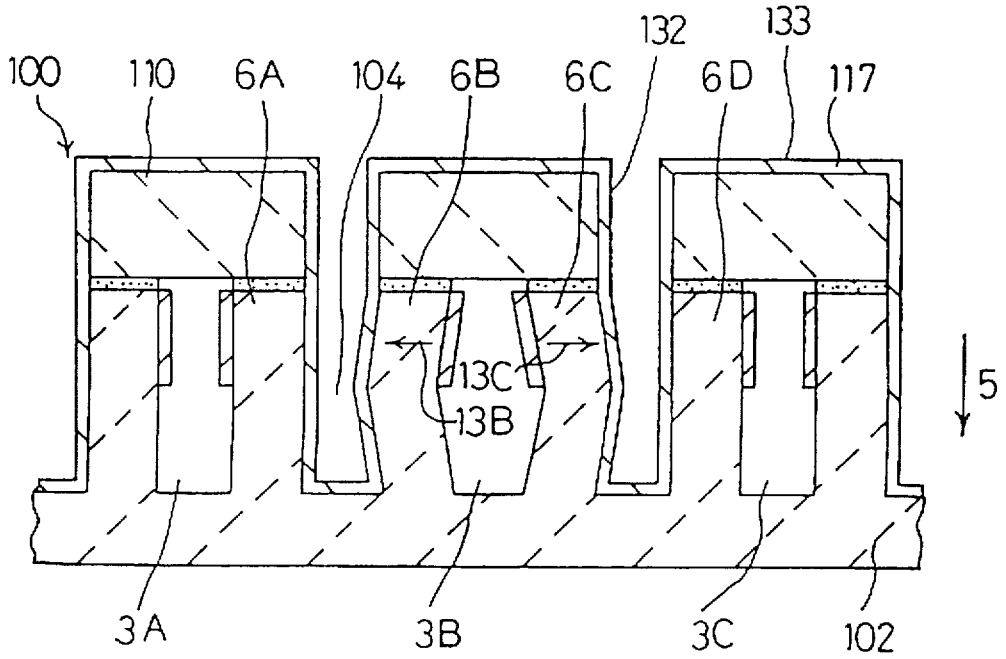
FIG. 8 is a diagram showing operation of the FIG. 6 ink-ejecting device.
Figure 9A:
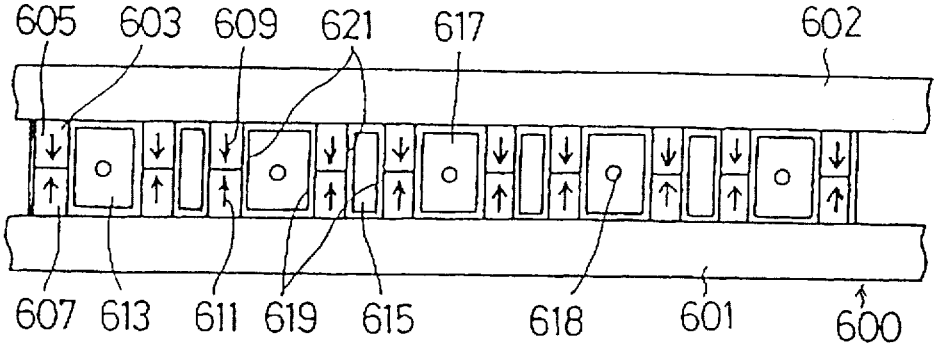
Fig.9 A PRIOR ART
FIG. 9A is a diagram showing a conventional ink-ejecting device.
Figure 9B:
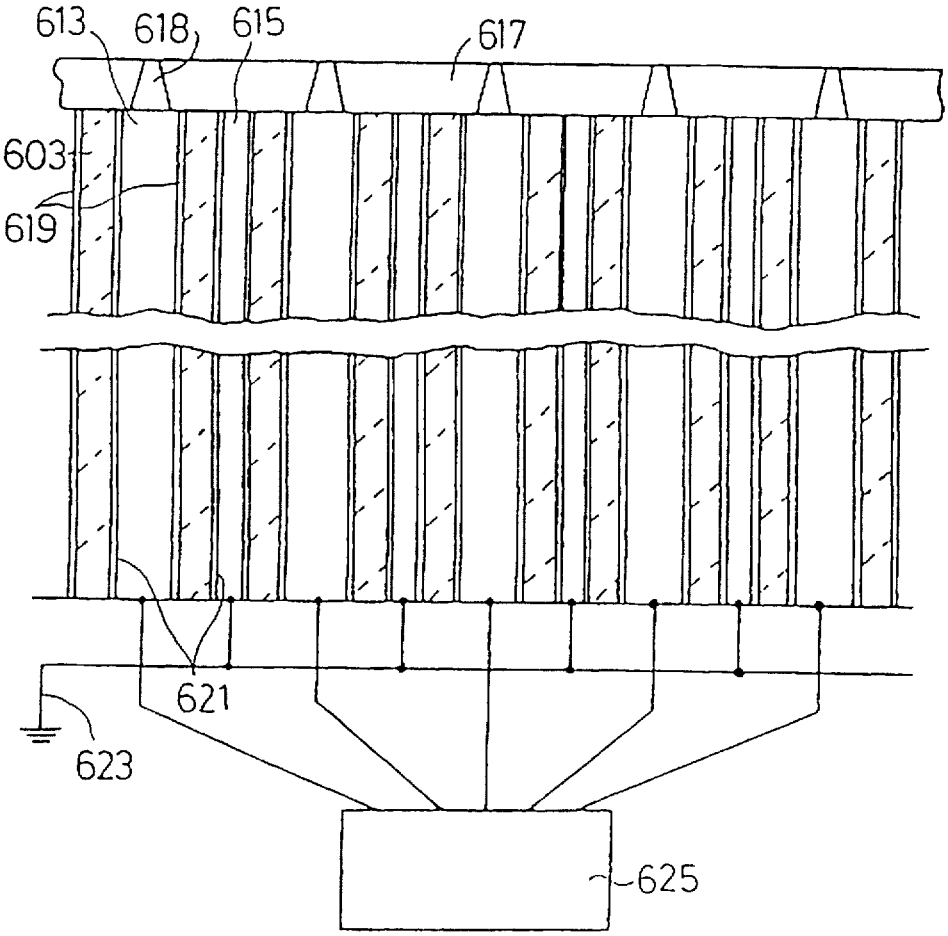
Fig.9 B PRIOR ART
FIG. 9B is a sectional plan view showing the FIG. 9A conventional ink-ejecting device.

When an ink droplet is ejected from an ink channel 3B shown in FIG. 8, a voltage pulse is applied to the ink channel 3B (here, the application of the voltage to the ink channel 3 means that the voltage is applied to the metal electrodes facing the ink channel 3, and the metal electrodes 8 facing the ink channels that are not specified and the metal electrodes 117 of the grooves 104 are grounded). Through this voltage application, an electric field acting in a direction as indicated by an arrow 13B occurs on a partition wall 6B, and an electric field directing in a direction as indicated by an arrow 13C occurs on a partition wall 6C, so that the partition walls 6B and 6C are deflected in a piezoelectric thickness shear mode and moved so as to be away from each other. In this case, the volume of the ink channel 3B is increased, and the pressure in the ink channel 3B (containing a peripheral portion of the nozzle 12) is reduced. This state is maintained for a time represented by L/a. During this time, ink is supplied from an ink supply source (not shown) through the manifold 21 into the ink channel.

According to pressure wave propagation theory, the pressure in the ink channel 3B is inverted when a time of L/a elapses from the voltage application as described above, so that pressure varies its polarity to a positive pressure. In synchronism with this timing, the voltage applied to the ink channel 3B is returned to OV. At this time, the partition walls 6B and 6C return to their initial states before deflection (FIG. 6), and the ink is pressurized. At this time, the positively varied pressure as described above is summed with a pressure that is induced by the return of the partition walls 6B and 6C to their initial states before deflection, so that a relatively high pressure is applied to the ink in the ink channel 3B and an ink droplet is ejected from the nozzle 12.

According to the second embodiment, the driving voltage is applied to increase the volume of the ink channel 3B, and then the application of the driving voltage is stopped to reduce the volume of the ink channel 3B to its natural (initial) state, thereby ejecting an ink droplet from the ink channel 3B. However, the driving voltage also can be applied first to reduce the volume of the ink channel 3B, thereby ejecting an ink droplet from the ink channel 3B, and then the application of the driving voltage is stopped to increase the volume of the ink channel 3B from the reduced state to the natural (initial) state, thereby supplying the ink into the ink channel 3B.

Further, according to the second embodiment, the metal electrodes 9 and 117 are connected directly to the flexible circuit 23. However, these electrodes may be connected to the flexible circuit 23 through a substrate, as with the first embodiment according to the invention.

As described above, in the ink-ejecting device 100 according to the second embodiment, the metal electrodes 117 can be formed simultaneously and easily on the inner surfaces of the grooves 104 and on the whole surface (containing the flat surface portion 116) of the piezoelectric ceramic plate 102 on which the grooves 104 are formed, because the grooves 104 are opened. Further, the metal electrodes 9 of the shallow grooves 7 of the ink channels 3 are individually and electrically independent of one another, and all the metal electrodes 117 of the grooves 104 are electrically connected to one another. Therefore, the electrical connection of the metal electrodes 117 on the inner surfaces of all the grooves 104 to the ground can be performed at at least one position. Accordingly, the connection to the patterns 24 and 25 of the flexible circuit 23, to connect the metal electrodes 117 to the LSI chip 51, can be facilitated.

According to the second embodiment, the grooves 104 are opened to the surface of the piezoelectric ceramic plate 110, and they do not intercommunicate with the manifold 21. Therefore, grooves 104 are filled with air, and thus the deflection of the partition walls 6B and 6C to eject an ink droplet from the ink channel 3B has no effect on the other ink channels 3A, 3C, etc. Accordingly, the ink droplet is precisely ejected from each ink channel 3, and excellent print quality can be obtained. Further, since the grooves 104 are filled with air, the partition walls 6 are easily deflected, and a low driving voltage may be used.

Further, by making the width of the grooves 104 to be smaller than the ink channels 3, the whole width of the piezoelectric ceramic plate 102 can be made smaller, and thus the device itself can be miniaturized.

While advantageous embodiments have been chosen to illustrate the invention, it will be understood by those skilled in the art that various changes and modifications can be made therein without departing from the scope of the invention.

What is claimed is:

1. An ink droplet ejecting device, comprising:

a plurality of adjacent partition wall structures extending in a longitudinal direction and defining a plurality of channels, said partition wall structures fabricated from a piezoelectric ceramic material and disposed apart from one another, each partition wall structure having a pair of outer sidewall surfaces whereby said outer sidewall surfaces of the adjacent partition wall structures are arranged in a facially opposing relationship with each other;

a plurality of longitudinally extending voids, each void being formed between said facially opposing outer sidewall surfaces of the adjacent partition wall structures;

a cover connected to said plurality of partition wall structures to cover said channels thereby forming longitudinally extending ink-ejecting chambers;

a pair of electrodes disposed in each of said ink-ejecting chambers, each electrode being connected to a respective one of a pair of facially opposing inner sidewall surfaces of each partition wall structure; and a continuous electrode extending continuously across said plurality of partition wall structures in a crossing direction transverse to the longitudinal direction and disposed in said voids and exteriorly of said ink-ejecting chambers, the continuous electrode connected to at least the outer sidewall surfaces of said partition wall structures and said cover.

2. An ink droplet ejecting device according to claim 1, wherein each electrode extends longitudinally within respective ones of said ink-ejecting chambers.

3. An ink droplet ejecting device according to claim 1, wherein each electrode is disposed to the respective one of the pair of facially opposing inner sidewall surfaces in a facially opposed relationship.

4. An ink droplet ejecting device according to claim 1, wherein said pair of electrodes are positioned within respective ones of said ink-ejecting chambers adjacent said cover.

5. An ink droplet ejecting device according to claim 1, wherein said cover and said partition wall structures are connected to each other by an adhesive material.

6. An ink droplet ejecting device according to claim 1, wherein said plurality of partition wall structures are a unitary construction.

7. An ink droplet ejecting device according to claim 1, further comprising a nozzle plate connected to said cover and said partition wall structures, said nozzle plate having a plurality of nozzles arranged in a manner so that each one of said plurality of nozzles is in fluid communication with a respective one of said ink-ejecting chambers.

8. An ink droplet ejecting device, comprising:

a plurality of adjacent partition wall structures extending in a longitudinal direction, fabricated from a piezoelectric ceramic material and disposed apart from one another, each of said partition wall structures having a pair of sidewalls extending parallel to each other and a transverse wall connecting said pair of sidewalls to form a longitudinally extending channel, said outer sidewall surfaces of the adjacent partition wall structures being arranged in a facially opposing relationship with each other;

a plurality of longitudinally extending voids, each void being formed between said facially opposing outer sidewall surfaces of the adjacent partition wall structures;

at least one cover connected to each respective pair of said sidewalls of said plurality of partition wall structures in a manner to cover said channels thereby forming longitudinally extending ink-ejecting chambers;

a pair of longitudinally ending electrodes disposed in respective ones of said ink-ejecting channels, each electrode being connected to a respective inner surface of each sidewall of said partition wall structure; and a continuous electrode extending continuously across said plurality of partition wall structures in a crossing direction transverse to the longitudinal direction, said continuous electrode disposed in said voids and exteriorly of said ink-ejection chambers and connected to at least the outer sidewall surfaces of said sidewalls and said cover.

9. An ink droplet ejecting device according to claim 8, wherein each electrode is disposed to the respective one of the pair of facially opposing inner sidewall surfaces in a facially opposed relationship adjacent said cover.

10. An ink droplet ejecting device according to claim 8, further comprising a nozzle plate connected to said cover and said partition wall structures, said nozzle plate having a plurality of nozzles arranged in a manner so that each one of said plurality of nozzles is in fluid communication with a respective one of said ink-ejecting chambers.

11. An ink droplet ejecting device according to claim 8, wherein one cover is connected to each respective pair of sidewalls of said plurality of partition wall structure.

* * * * *